United States Patent [19]

Crane

[11] 4,203,233

[45] May 20, 1980

[54] CALF-TYING PRACTICE DUMMY

[76] Inventor: Charles J. Crane, Rte. 1, Box 63D, Tolleson, Ariz. 85353

[21] Appl. No.: 918,499

[22] Filed: Jun. 23, 1978

[51] Int. Cl.[2] ..... A63B 69/04

[52] U.S. Cl. ..... 35/29 R; 46/123; 46/162

[58] Field of Search ..... 35/29 R; 46/123, 129, 46/162; 272/52; 280/1.181

[56] References Cited

U.S. PATENT DOCUMENTS

| | | | |
|---|---|---|---|
| 2,560,657 | 7/1951 | Nogle | 35/29 R X |
| 2,613,080 | 10/1952 | Dow | 46/123 X |
| 2,846,810 | 8/1958 | Ory | 46/123 |
| 2,896,948 | 7/1959 | Brodrib | 46/123 X |
| 3,716,941 | 2/1973 | Dowden | 46/123 |

*Primary Examiner*—Harland S. Skogquist

*Attorney, Agent, or Firm*—Cahill, Sutton & Thomas

[57] ABSTRACT

A practice dummy is disclosed for use in practicing the flanking, stepping over, and tying phases for rodeo calf-roping and goat-tying events. The main body of the practice dummy is constructed from half of an automobile tire of suitable size and flexibility. Two rear leg members and one front leg member are detachably connected to the respective sidewalls of the tire. The main body and the legs are covered with a durable carpet-like fabric to simulate the fur and hide of a live calf. The practice dummy can be flanked in the same manner as a live calf. The flexible body of the half tire imparts a resisting force to the legs when they are crossed and tied with a calf-tying knot, causing the legs to kick loose from the calf-tying knot if it is not securely tied.

4 Claims, 7 Drawing Figures

CALF-TYING PRACTICE DUMMY

BACKGROUND OF THE INVENTION

1. Field of the Invention

The invention relates to model calves to be used for practicing tying for rodeo calf roping and goat tying events.

2. Description of the Prior Art

The calf roping competition is one of the top events in modern rodeo, including amateur rodeo and professional rodeo. In the calf roping event, the contestant is initially seated upon his horse behind a starting line. A calf, typically weighing from 200 to 300 pounds, is let out of the chute, and runs toward the other end of the arena. As soon as the calf emerges from the chute, the contestant chases the calf on his horse, and attempts to rope the calf as quickly as possible. The horse is trained to move backward at this point and keep the lariat, which is hooked to the saddle horn, taut. Meanwhile, the contestant leaps off the horse runs toward the calf, and "flanks" or throws the calf to the ground. The contestant then "scoops" the hind legs of the calf and crosses them over its foreleg, and utilizes a "piggin' rope" to tie three of the legs of the calf together. The contestant then throws his arms up or out when he is finished. If the calf does not manage to kick loose from the calf-tying knot, the contestant's time is recorded. The object, of course, is to perform the entire operation in the minimum amount of time. Competition is extremely intense in all rodeo events, since contestants ordinarily pay a large entry fee for each event, and only the winner collects a prize. Each year the top professional cowboys in the United States win a great deal of prize money. Numerous amateurs all over the western part of the United States also complete in various rodeo events, mainly for the sport of it.

A great deal of both practice and athletic ability are required to develop sufficient skill to be a winner in either amateur or professional rodeo events; this is especially true in the calf roping event. The various phases of the calf tying event require months and years of continual practice, not to mention the requirement of well trained roping horses, to become competitive. For a rodeo in which world class contestants complete in the calf roping event, event times in the range from sixteen to twelve seconds are fairly common. Times under twelve seconds have a good chance of winning. Of the ten to twelve seconds required for the entire event, the "stepping across" and "tying" phases take only approximately two and a half to three seconds. Since the tying of three legs of the calf in a secure knot is a very complex procedure, a great deal of practice is required. For example, a typical fourteen year old boy who practices six hours a week for six months might be expected to decrease the average time required to tie a calf from approximately forty seconds to approximately twenty seconds. Much more time is spent in practice to get down to the times of less than five seconds required to enable a contestant to win in most amateur rodeos. A similar rodeo event, called the goat-roping event, is designed for girls. The techniques for developing skill in the typing operation of the goat tying event are essentially the same as for the calf tying event.

Accordingly, it is an object of the invention to provide a device which aids rodeo competitors to increase their skill in the flanking, stepping over, scooping, and tying aspects of the calf-roping rodeo event.

The complexity of the calf roping event and the tying phase of that event is expertly set forth in "Calf Roping," by Toots Mansfield (Seven Time World Calf Roping Champion), 1961, Western Horseman, Inc., Colorado Springs, Colo.

Practicing the typing phase of the calf roping event and goat tying event is usually obtained utilizing live calves or goats. However, this is very expensive and is also inhumane to the calves or goats. Since the calf must be "flanked" (i.e., grasped by the hide around his flank, lifted, and thrown onto his side on the ground) each time the knot is tied, practicing for the event is hard on the calf, to say the least. Internal injuries and even death can be caused if the same calf is used a large number of times in a short period of time. Ordinarily, a calf should not be flanked more than four times in one day, and should not be forced to lie on its side for more than a few minutes each day. To solve the problem of inhumane treatment of rodeo stock, various motorized roping steers and other apparatus have been invented for practicing the roping phases of various rodeo events. The state of the art in this area is generally indicated by U.S. Pat. Nos. 3,324,832; 3,406,969; 3,711,098; 3,776,553; 3,802,706; 3,947,033; 3,974,799; and 3,962,995. However, none of the devices described in the above patents is useful for practicing the flanking and tying phases of the calf roping or goat tying events.

It is therefore another object of the invention to avoid the necessity of using live animals for practicing the flanking and tying operations for calf roping and goat tying rodeo events.

I have seen one prior device constructed of two wooden boxes bolted end to end, and having three wooden legs, formed from "2×4's" hingably connected to the opposed ends of the wooden box-like body. As the three legs of the model are scooped and crossed over the foreleg in preparation for tying, a spring assembly mounted at the connecting point of each leg resists the movement of the legs. Each spring arrangement includes a shaft mounted on an inside corner of the box and extending through a hole in the 2×4 leg. A coil spring disposed around the portion of the shaft extending beyond the hole in a leg is retained on the shaft by means of a nut or bolt head. The springs are compressed as the legs are bent inward toward the other legs. However, this calf roping model has been found to be quite unsuited to the type of practice necessary to enable a contestant to bring his tying time down to the five second and less range. Those familiar with the techniques which must be developed to become proficient in calf tying will realize that any practice dummy should be as much like a live calf as possible so that the hours of practice are not spent in learning incorrect techniques to compensate for unnatural reactions produced by a practice dummy. Once such incorrect techniques are learned, they would prevent the contestant from proficient tying of live calves during actual competition.

Accordingly, it is an object of the invention to provide a calf-tying practice dummy which simulates resistance to having its hind legs scooped, crossed over its foreleg, and tied together similarly to a live calf to permit a contestant to practice to become proficient in calf roping or goat tying rodeo competition.

The above-mentioned wooden practice dummy has numerous shortcomings which make it unsuitable for practicing calf-tying knots and for practicing flanking.

These disadvantages can be best understood after some of the basic techniques involved in calf-tying are explained.

As explained in chapter nine in the above book entitled "Calf-Roping," there are approximately sixteen separate steps which must be properly performed after the contestant has the calf lying on the ground and has stepped across the calf to assume a proper position over the calf. First, a loop in the piggin' string is placed over the calf's foreleg above the fetlock joint and is tightened. The calf's hind legs are then "scooped" up and forward and crossed over the foreleg, which is held with the contestant's left hand. The piggin' string is grasped with the contestant's right hand, and is very rapidly wrapped twice around all three legs; the piggin' string is allowed to slip through the contestant's right hand as the wrap progresses. The two wrapping operations are done at very high speed and in such a manner that the outer edge of the right hand controls the twirl of excess piggin' string to avoid snagging and fouling of the wrapping operation. The velocity of the free end of the piggin' string is so great that is causes a hissing sound, and could cause injury to either the contestant or a bystander if struck by the free end during the wrapping operation. A third wrap is then made at the same time that the contestant releases the calf's foreleg with his left hand. The contestant moves his left hand over the knot being tied, so that in the course of the third wrap, the piggin' string is looped over the thumb of the left hand, as indicated in FIG. 6 of the drawings herein. As the piggin' string is looped under the calf's two rear legs during completion of the final wrap, the piggin' string is brought up between the two rear legs and the foreleg, and is grasped by the fingers of the left hand. The piggin' string is then released by the right hand and jerked through the loop formed by the third wrap over the left thumb of the contestant, and is pulled tight by the contestant's left hand to form a half hitch knot, as shown in FIG. 7 of the drawings herein.

In order to become a winner in the calf roping event, the contestant must practice until he is able to perform the foregoing scooping, wrapping and tying operations in a total time of approximately three seconds. It should be born in mind that the piggin' string is approximately six feet long, and a great deal of practice and skill is required in order to cross the legs of the calf and manipulate the six foot piggin' string to provide a secure calf-tying knot which the calf cannot kick free of.

The above described wooden calf-tying dummy had been found to be completely unsuitable for practicing the complex calf-tying operation. One problem is that in the course of making the high speed wraps, the contestant hits his hands, especially his knuckles on the wooden legs, bruising, cuttin, and getting wooden splinters in his hands and knuckles.

Accordingly, it is an object of the invention to provide a calf-tying practice dummy which prevents a contestant from bruising or injuring his hands as he practices.

Another problem with the wooden dummy is that its "back" doesn't bend or flex, since the body is formed of a pair of wooden boxes rigidly bolted together. The back of a live calf arches or bends as the rear legs are scooped forward and the foreleg is brought back and crossed under the rear legs. The manner in which the spring loaded wooden legs of the prior wooden dummy swing forward and are crossed is completely un-natural. Consequently, a contestant will learn improper techniques by continued practice on such a dummy. Another problem with the wooden calf-tying dummy is that its foreleg and rear leg members only swivel laterally, but do not freely swivel transversely. The legs of a live calf, when it is lying on the ground on its side, are quite limber, and swivel both laterally from back to front and also transversely, so that the rear legs can be scooped up and lifted forward and crossed over the foreleg without lifting much of the body weight of the calf. The prior wooden calf tying dummy requires that a substantial portion of the weight of the wooden body be lifted in order to perform the above operation. The lack of transverse swivelability of the legs makes the required crossing of the hind legs and foreleg very awkward and un-natural. This phase of the calf-tying operation can not therefore be adequately practiced using the prior wooden dummy.

It is another object of the invention to provide a calf tying practice dummy having legs which swivel freely in the transverse direction to permit the scooping and crossing of the hind legs over the foreleg without lifting a significant portion of the body weight of the practice dummy.

Another shortcoming of the prior wooden dummy is that it is totally unsatisfactory for practicing flanking of the calf. Its structural rigidity would cause it to gradually weaken and break up if repetitively grasped and thrown to the ground. The wooden edge of the box-like body is not suitable for practicing to achieve proficiency in grasping the flexible, fur covered flank of a live calf.

It is therefore another object of the invention to make a calf roping practice dummy suitable for practicing the flanking protion of the calf roping rodeo event.

Those skilled in the rodeo art know that the long hours of practice which are required to gain consistency can result in acquiring of firmly ingrained incorrect techniques as well as correct techniques. The prior wooden practice dummy is totally unsuitable for developing the combination of proper techniques needed to become proficient in the calf-tying operation, and results in learning of improper techniques. Consequently, only one of the above-described wooden practice dummys has been built. There is an unmet need for an improved calf-tying practice dummy which permits a contestant to effectively and properly practice the wrapping and tying operations for the calf-roping and goat-tying rodeo events.

It is therefore another object of the invention to provide an inexpensive, portable, durable practice dummy for practicing for the calf-roping and goat-tying rodeo events.

SUMMARY OF THE INVENTION

A calf-tying practice dummy has a main body formed from half of a tire. The practice dummy has two rear legs and one foreleg. The legs are formed from hollow, metal tubing, and are detachably connected to the respective inside edges of the sidewall of the half tire by means of uni-couple fittings. The uni-couple fittings are permanently bolted to the respective inside edges of the sidewalls. The legs are secured to the uni-couple fittings by means of set screws thereof. The half-tire is covered with a fitted cover made of polyester sheepskin which simulates the hide and fur of a live calf. The legs are also covered with polyester sheepskin fabric. A head is attached to the practice dummy. The tire is selected to have sufficient rigidity that the legs resist being scooped, crossed, and tied in an approximately natural manner with an approximately natural amount of force as a person practices tying for the calf-roping event or goat tying event. The polyester sheepskin cover over the half tire body of the practice dummy can be grasped by the person so that he or she can "flank" the practice dummy in the same manner as a live animal. In one embodiment of the invention, additional weights are attached to the inside of the half tire casing to provide a desired weight for the practice dummy.

DESCRIPTION OF THE DRAWINGS

Figure 1:
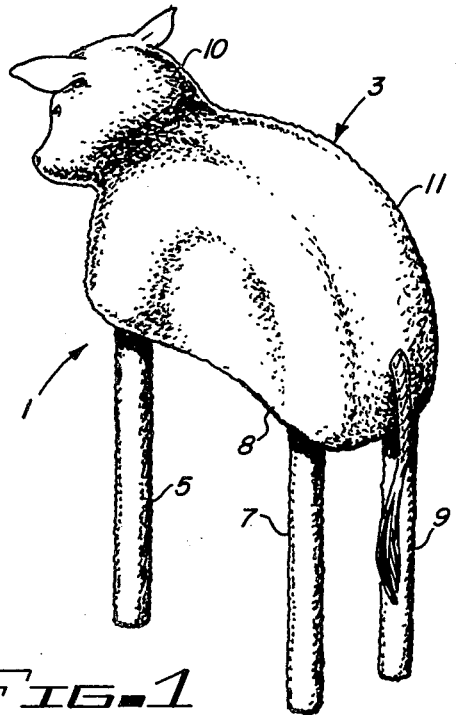
FIG. 1 is a perspective view of a calf tying practice dummy of the invention.

Referring now to FIG. 1, calf roping model 1 includes a main body 3. Body 3 has a dummy head 10 attached thereto. Body 3 is covered with a commercially available carpet-like fabric. A foreleg 5, also coated with the carpet-like fabric, is attached to the lower forward portion of body 5, in the manner shown in FIGS. 2–4. Similarly, a left rear leg 7 and a right rear leg 9 are attached to opposite hind quarter portions of body 3. Rear legs 7 and 9 are also covered with the carpet-like fabric.

The carpet-like fabric forms a flank section 8, which can be grasped by the practicing cowboy or cowgirl to throw calf roping dummy 1 to the ground in the same manner that a live calf is "flanked" during an actual rodeo event.

Figure 3:
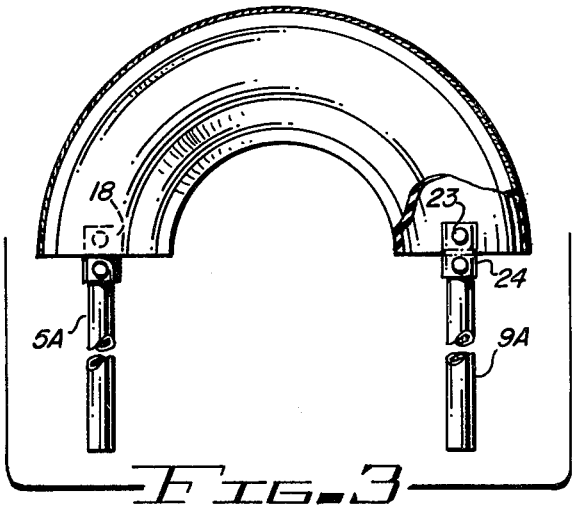
FIG. 3 is a partial cutaway side view of the framework shown in FIG. 2.
Figure 6:
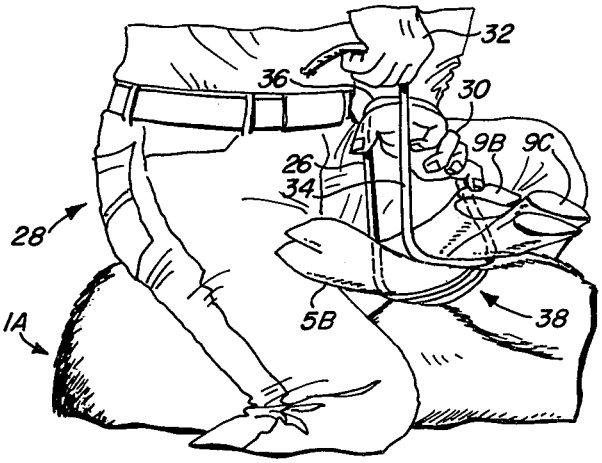
FIG. 6 is a perspective drawing indicating one phase of forming a calf-tying knot.
Figure 2:
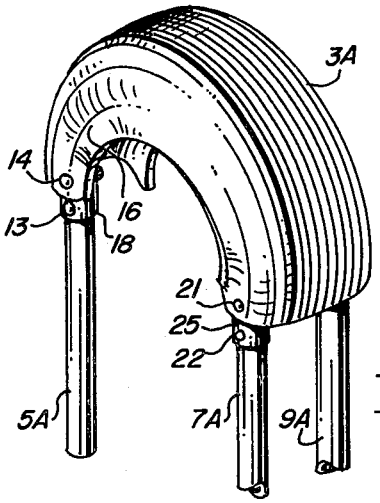
FIG. 2 is a perspective view showing the framework for the practice dummy of FIG. 1.
Figure 5:
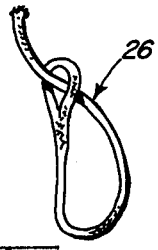
FIG. 5 is a drawing showing part of a piggin' string.
Figure 7:
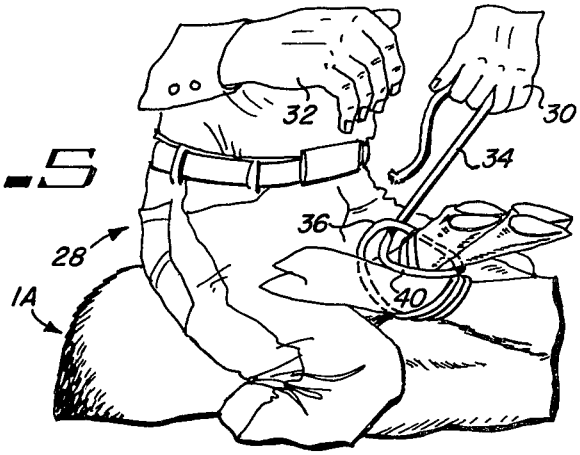
FIG. 7 is a perspective drawing showing the final phase of forming a calf-tying knot.
Figure 4:
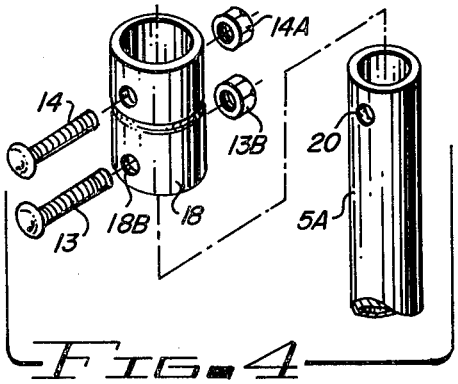
FIG. 4 is a perspective diagram showing apparatus for attachment of the leg members to the half tire shown in FIG. 2.

Referring now to FIGS. 2–4, it is seen that the inner frame of calf roping dummy 1 includes a half tire 3A coupled to three tubular leg members 5A, 7A, and 9A attached to a front inner side wall and two rear inner side walls, respectively, of half tire 3A. Half tire 3A is a section of a four ply 7:00–15 tire. The side walls of half tire 3A are sufficiently stiff to provide flexing with the desired amount of counter-resistance to forces applied to the three legs 5, 7, and 9 when the hind legs are scooped and crossed over the foreleg 5 to practice tying the knot previously described herein.

The three tubular leg members 5A, 7A and 9A are attached, respectively, to body 3A by means of three cylindrical coupling elements 18, 25, and 24, respectively, referred to as uni-couple fittings. Each of the coupling elements 18, 25, and 24 is bolted to an inner sidewall of half-tire 3A. More particularly, coupling element 18 is bolted to the front inner side wall 16 of half tire 3A by means of bolt 14. Similarly, coupling element 25 is bolted to the rear portion of the side wall 16 by means of bolt 21, and coupling element 24 is bolted to the opposite inner side wall of body 3A by means of bolt 23.

The details of coupling element 18 and the manner in which tubular leg member 5A is attached thereto are clearly shown in FIG. 2. Coupling element 18 is permanently bolted to the inner surface of forward sidewall by means of bolt 14 and nut 14A, wherein bolt 14 extends through hole 18A. Tubular leg member 5A has an outside diameter slightly less than the inside diameter of coupling element 18, and fits snuggle into the inner cylindrical section of cylindrical element 18. Bolt 13 extends through hole 18B of coupling element 18 and hole 20 of tubular leg member 5A, and is securely fastened by means of nut 13B. Alternately, bolt 13 can be threaded into hole 18B if hole 18B is approximately threaded.

FIG. 3 more clearly shows the connection of tubular members 5A and 9A to the side walls of tire 3A by means of coupling elements 18 and 24, respectively.

Thus, it is seen that legs 5, 7 and 9 of calf roping dummy 1 can be readily and conveniently removed, so the legs and body thereof may be easily stored in the storage compartment of a horse trailer or the trunk of an automobile.

In the described embodiment of the invention, the leg members 5A, 7A, and 9A are formed from metal electrical thin wall conduit having an inside diameter of $\frac{3}{4}$ of an inch and a length of twenty-four inches. The coupling elements 18, 24, and 25 are preferrably uni-couple fittings with preset setting screws. The fabric utilized to cover the main body and leg members is manufactured by Norwood Mills Corporation of Wisconsin. This material is a 100 percent polypropylene olefin material referred to as polyester sheepskin.

The calf-tying practice dummy described herein has been found to be suitable for prolonged practice of the wrapping and tying operations previously described. The contestant's knuckles are not subject to being bruised or splintered because of the light weight of the leg members and because of the polyester sheepskin covering thereof. The polyester sheepskin wrapping around the half tire forming the main body can be grasped by the contestant's hands, permitting the contestant to practice flanking operations required in the calf-roping event. Suitable weights can be attached within the casing of the half tire to provide a suitable and realistic balance for the body of the practice dummy, or can be omitted for young contestants, thereby avoiding strained muscles and tiring of the contestant due to the weight of the practice dummy. Realistic resistance imparted to both rear-to-front swiveling and transverse swiveling of the rear legs and the foreleg by the flexing of the half tire produces realistic reactions of the dummy model during the scooping and crossing operations of the calf-tying procedure. The contestant can therefore practice high speed scooping, crossing, wrapping, and tying of the dummy model without self injury and without accumulating or adopting of improper techniques which interfere with his proficiency during live competition.

Although the invention has been described with reference to a particular embodiment thereof, those skilled in the art will recognize that certain variations in materials, arrangement of elements, and cooperation therebetween may be made within the true scope and spirit of the invention. It is therefore intended that the scope of the invention be limited only by the appended claims.

I claim:

1. A practicing dummy for assisting a person in practicing for rodeo calf-tying events, said device comprising in combination:

(a) a front leg member;

(b) first and second hind leg members; and (c) body means connected to said front leg member and said first and second hind leg members for supporting and orienting said front leg member and said first and second hind leg members approximately perpendicularly to an axis of said body means and applying resisting forces tending to counteract any forces displacing said front leg member and said first and second hind leg members from said perpendicular orientations thereof, said counteracting forces being sufficient in magnitude to untie an insecurely tied calf-tying competition knot, said body means flexing in an approximately natural manner during scooping of said first and second hind leg members and crossing said first and second hind leg members over said front leg member during said practicing, wherein said body means is composed of a half of an automobile tire, said front leg member being bolted to one end of said half-tire and said first and second rear leg members being bolted to opposed side walls of the other end of said half-tire.

2. The practice dummy of claim 1 further including a carpet-like covering disposed loosely over said body means and disposed about said front leg member and said first and second rear leg members.

3. The practice dummy of claim 2 wherein said carpet-like cover is composed of polyester sheepskin fabric.

4. The practice dummy of claim 1 wherein said front leg member and said first and second hind leg members are detachably connected to said half-tire to permit said practice dummy to be conveniently stored.

* * * * *